United States Patent [19]

Rehling

[11] Patent Number: 4,750,527

[45] Date of Patent: Jun. 14, 1988

[54] METHOD AND DEVICE FOR CONTROLLING A WARP BEAM DRIVE OF A WEAVING MACHINE

[75] Inventor: Walter Rehling, Holzwickede, Fed. Rep. of Germany

[73] Assignee: Maschinenfabrik Stromag GmbH, Unna, Fed. Rep. of Germany

[21] Appl. No.: 894,250

[22] Filed: Aug. 7, 1986

[30] Foreign Application Priority Data

Aug. 7, 1985 [DE] Fed. Rep. of Germany ..... 3528280

[51] Int. Cl.[4] ..... D03D 49/06; D03D 49/18; D03D 51/00

[52] U.S. Cl. ..... 139/110; 139/1 E; 139/97; 139/100

[58] Field of Search ..... 139/99, 100, 103-110, 139/1 E, 1 R

[56] References Cited

U.S. PATENT DOCUMENTS

| | | | |
|---|---|---|---|
| 4,122,873 | 10/1978 | Pfarrwaller et al. | 139/102 |
| 4,364,002 | 12/1982 | Suzuki et al. | 139/1 E |
| 4,529,012 | 7/1985 | Sainen et al. | 139/105 |
| 4,537,226 | 8/1985 | Gotoh | 139/100 |
| 4,554,951 | 11/1985 | Hirano et al. | 139/105 |
| 4,564,050 | 1/1986 | Hirano | 139/105 |
| 4,619,294 | 10/1986 | Sainen et al. | 139/109 |

*Primary Examiner*—Harvey C. Hornsby
*Assistant Examiner*—Joseph S. Machuga
*Attorney, Agent, or Firm*—Biebel, French & Nauman

[57] ABSTRACT

In a control for a warp beam drive of a weaving machine, the warp beam drive is regulated at all times by a control which receives input signals representing the number of rotations of the warp beam and representing the tension of the warp threads. If the weaving machine has come to a standstill because of an error which has taken place, then, before the warp beam drive is re-started, the tension on the warp threads is increased to a specific value by rotating the warp beam in reverse, in order, during re-start, to take warp thread tension back to a predetermined normal value again through suitable action on the warp beam drive. The effect of this is that no stop marks or start marks are formed in the woven material as a result of the weaving machine having stood still. This control includes a digital computer, to which the number of rotations of the warp beam is supplied by means of an impulse transmitter, and the tension of the warp threads supplied by means of a motion pickup, which picks up the position of a dancer. The signal from the impulse transmitter guided to the computer is used not only as a number-of-rotations signal, but also as a route signal, especially when the tension on the warp threads is raised to the specific increased value.

4 Claims, 1 Drawing Sheet

METHOD AND DEVICE FOR CONTROLLING A WARP BEAM DRIVE OF A WEAVING MACHINE

BACKGROUND OF THE INVENTION

The invention relates to a method of controlling a warp beam drive of a weaving machine in which the warp beam drive speed is proportional to a value governed by the number of rotations of the warp beam and the tension of the warp thread, and to a device for carrying out the method which includes a control for influencing the warp beam drive, and a device for measuring the tension of the warp threads and generating a signal to the control.

Such a method, as well as a suitable device for carrying out the method, is disclosed in German Pat. No. 29 39 607. There, the tension of the warp threads is measured by the position of a dancer, and the number of revolutions of the warp beam is recorded by means of a driving pinion. Both measurements are supplied to a controller or regulator, which controls a driving unit that drives the warp beam at a predetermined speed.

The aforementioned device does not deliver satisfactory weaving results, particularly when the warp beam is started up from a stationary condition. In such instances, so-called "stop marks" or "start marks" are formed in the woven fabric. This flaw originates from the fact that the dancer is inclined to overswing or over-shoot on starting up and therefore no longer delivers any usable or rated or ideal value for the controller.

Also, the starting-up setting means proposed in the aforementioned patent, which supplies a specific starting curve for starting up the warp beam drive and thereby replaces the position of the dancer as a nominal or rated value signal, can only to a limited extent eliminate the occurrence of stop marks in the woven fabric.

SUMMARY OF THE INVENTION

The object of the invention is to improve the known method in such a manner that no flaws or errors occur even when the warp beam drive is started up from a stationary condition, and therefore no stop marks or start marks are formed in the woven fabric. The method of the invention is a modification of the known method in that, before the warp beam drive is started up again from a stationary state, the tension of the warp threads is raised to a predetermined value by rotating the warp beam backward or in reverse and, during the starting-up is taken back to a likewise-predetermined value through action on the warp beam drive. In this manner, for one thing, the tension of the warp threads normally used as the rated or nominal value is replaced by predeterminable values or functions, and for another thing, the tension of the warp thread is adjusted to these values or functions by rotation of the warp beam. In that way, it is possible to influence the starting-up process of the warp beam drive so precisely that no stop marks or start marks can be detected in the woven fabric.

In one embodiment of the invention, the predeterminable normal value corresponds to the value of the tension of the warp threads before the warp beam is first started up, while the predeterminable heightened value forms a constant difference with the normal value, which for its part is dependent on the starting-up behavior of the main drive.

In a further embodiment of the invention, the type and manner of taking into consideration the tension of the warp threads when the warp drive is started up are attained by the fact that the setting-back of the tension of the warp threads from the predeterminable heightened value to the normal value is performed in the form of a pre-supposed time-dependent function. In that way, it is possible to adapt the lowering of the tension of the warp threads precisely to the starting-up behavior of the main drive and thereby to avoid any flaws or errors in starting up.

In a particularly advantageous embodiment of the invention, the regulating or control device is designed in digital form, particularly in the form of a suitably-programmed digital computing apparatus. The device for measuring the number of rotations of the warp beam is realized with the aid of an impulse emitter coupled to the warp beam, which generates a specific number of digital impulses per whole rotation of the warp beam. The device for measuring the tension of the warp threads is put into effect by means of a potentiometer, which detects the position of a tension roller which determines the tensile stress or strain of the warp threads, and to which an analog-digital converter is coupled at the outlet side. With this arrangement, it is possible that the regulating or controlling device can at every moment detect and process, exactly, the tension of the warp threads and the number of revolutions of the warp beam. Therewith it is also possible, in a case where the warp beam drive is standing still, to raise the tension of the warp threads to the predetermined value and to reset it again to the normal value during the starting-up of the warp beam drive.

Of particular advantage in connection with the invention is the use of the impulse transmitter, since with the latter not only the number of revolutions of the warp beam drive, but also the number of impulses which result through turning the warp beam backward in order to increase the tension of the warp threads, can be measured. This number can be further used to particular advantage in forming the starting-up function.

With the apparatus of the present invention, the forward movement of the interwoven warp threads—that is, the woven fabric—is measured with the aid of a second impulse transmitter which is coupled to a shaft that is operatively connected to the woven warp threads by means of friction. The velocity of the forward movement of the interwoven warp thread serves to further act upon the regulating of controlling device and therewith to influence the warp beam drive.

The warp drive itself is provided as a drive which is regulatable in its number of rotations by means of alternate actuation of a coupling and a brake. Optionally, however, any other regulatable drive may be employed.

Further features and advantages of the invention will be apparent from the claims as well as from the following description with reference to the drawing, in which is shown a preferred embodiment.

DETAILED DESCRIPTION OF THE PREFERRED EMBODIMENT

Figure 1:
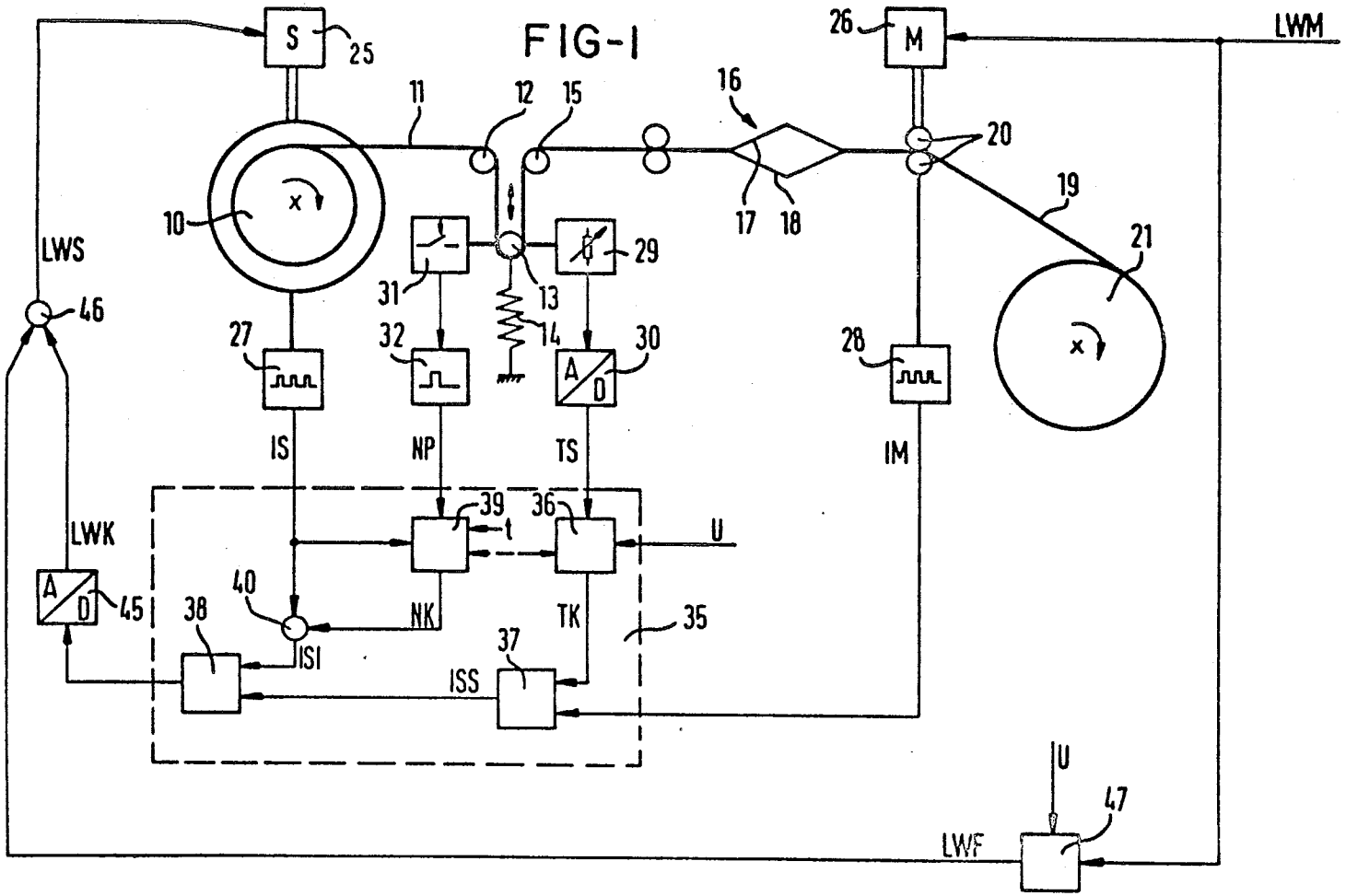
FIG. 1 shows a schematic block circuit diagram of a regulator or control in accordance with the invention.

In FIG. 1, warp threads 11 are unwound from a warp beam 10 and guided by means of a first deflector roll 12, a dancer 13, and a second deflector roll 15 to a weaving machine, which is indicated schematically by the reference numeral 16. There, the warp threads 11 are subjected to the shedding process, whereby the warp threads designated 17 form the upper warp and those designated 18 form the lower warp, through which the woof or filling threads are guided in a conventional manner. Leaving the weaving machine 16, the now-interwoven warp threads 11—that is, the woven fabric 19—run between two driving rollers 20 and thereafter are wound upon roll 21.

The warp beam 10 is driven by a warp beam drive 25, while the two driving rollers 20 are set into motion by means of a roller drive 26. The roller drive 26 is the main drive and is therefore labelled with an M, because it is a "Master Drive"—that is, an independent drive—while the warp beam drive 25 is characterized by an S, because it is a "Slave Drive"—that is, the drive is dependent on the roller drive 26. To the warp beam 10 and to one of the two drive rollers 20 are connected impulse transmitters 27 and 28, respectively, each of which generates a specific number of digital impulses at every rotation of the warp beam 10 or the drive rollers 20.

As an example, this may be accomplished by fastening a disk, which has teeth on its outer edge, to the shaft of the warp beam 10 or to one of the two drive rollers 20. The number of rotations of the shaft is then detected by a device—a light barrier, for example—which detects the individual teeth as they pass by and emits a signal for each tooth which has moved past. An impulse-former stage connected to this device can then upgrade this signal to a corresponding digital impulse. The number of such digital impulses per specific unit of time then yields the number of rotations of the shaft. At the same time, with such an impulse transmitter, it is possible, to certain extent, also to perform angular or odometrical measurements in one rotation of the shaft, by counting the number of impulses generated by this rotation and combining them with the spacing of the teeth of the impulse transmitter.

The dancer 13 serves to equalize the variations of velocity of the warp threads 11 which originate through the shedding process. For this reason, the dancer 13 moves up and down synchronously with the shedding process. The dancer 13 is held by a spring 14, so that the warp threads 11 are always under tension. The position of the dancer 13 is detected by a motion pickup 29 and a zero-point pickup 31. An analog-digital converter 30 is connected to the motion pickup 29 and an impulse former 32 is connected to the zero-point pickup 31.

The motion pickup 29 may, for example, be designed in the form of a potentiometer whose pickup is coupled to the dancer. On the other hand, the zero-point pickup 31 may be a switch which is closed at a specific, predetermined position of the dancer 13 but otherwise is always open. The output signals from the impulse transmitter 27, the impulse former 32, the converter 30, and the impulse former 28, designated IS, NP, TS, AND IM respectively, are suplied to a computing apparatus 35, which as a further input signal is acted upon by a value U and which generates an output signal which is put through to a digital-analog converter 45.

The computing apparatus includes a conversion computation 36, a nominal value computation 37, a theoretical-actual comparator 38, an actual-value correction 39, and a linkage 40. The signal TS and the signal U are supplied to the conversion computation 36, while the signal NP and the signal IS are conducted to the actual-value correction 39. Depending on its two input signals, the conversion computation 36 generates an output signal TK, which acts upon the nominal value computation 37 together with the signal IM. The output signal from the nominal value computation 37 is designated ISS and is connected to the theoretical-actual comparator 38. From its two input signals NP and IS, as well as from a signal t, which represents time, the actual-value correction 39 forms an output signal NK, which together with the signal IS is connected to the linkage 40 and there is combined to form signal ISI. Finally, this signal ISI is guided as a second input signal to the theoretical-actual comparator 38, whose output signal controls the converter 45.

The number of rotations of the roller drive 26 is given by a signal LWM, which on one hand is supplied to the roller drive 26 and on the other hand is supplied to a converter 47. With the aid of the converter 47, and in dependence on the aforementioned signal U, the signal LWF, which is connected to a linkage 46, to which likewise the output signal LWK from the converter 45 is suplied, is generated from the signal LWM. Finally, the output signal from the linkage 46 is designated LWS, and, for the purpose of controlling the warp beam drive 25, is connected to the latter.

The signal LWM is constant and causes the roller drive 26 to drive the driving rollers 20 at a likewise contant number of revolutions. Therefore, the woven fabric 19 is pulled off out of the area of the weaving machine 16 at a uniform velocity. Since the roller drive 26 is the independent drive (Master Drive), the dependent warp beam drive 25 (Slave Drive) must be adjusted to this constant pull-off velocity of the woven fabric 19. This is accomplished by means of the linkage of the signals LWF and LWK to the signal LWS.

If the warp beam 10 should have a constant diameter during the entire period of operation of the regulation or control, a constant relationship would result therefrom between the number of rotations of the warp beam 10 and the number of rotations of the drive rollers 20. In such a case, it would suffice to link the signal LWM, which controls the roller drive 26, with the aid of the converter 47 at the same relationship, in order then to directly control the warp beam drive 25 with the output signal LWF. In that case, the signal LWK would be permanently zero because of the constant conversion relationship.

However, since the warp threads 11 unwind from the warp beam 10, its diameter gradually becomes smaller with each layer of thread unwound from it. For this reason, it is not sufficient to operate with a fixed relationship of the numbers of rotations of the drive rollers 20 and the warp beam 10; rather, the number of rotations of the warp beam 10 must be corrected because of the constant reduction of its diameter—put more precisely, must be heightened or increased. This is accomplished with the aid of the signal LWK generated by the computing apparatus 35, which influences the warp beam drive 25 by means of the linkage 46.

In order that compensation for the diminution of the diameter of the warp beam 10 may be possible, the actual diameter of the warp beam must be measured before the first start-up of the entire regulation or control, and the conversion relationship of the number of revolutions of the warp beam 10 and the driving rollers 20 must be computed therefrom. This conversion relationship must be conveyed, as signal U, to the computing apparatus 35 and the converter 47. Furthermore, before the first start-up of the regulation or control, the actual position of the dancer 13 must be adjusted so that it corresponds to the position detectable by the zeropoint pickup. Thus the zero-point pickup 31 must then precisely emit a signal when the dancer 13 is situated in this actual position.

If the weaving machine has been started up, the regulation or control is in operation, and the dancer 13 moves regularly up and down, as already mentioned. If the diameter of the warp beam 10 does not vary, the mean value of this movement also remains constant. However, if one thread layer is unwound from the warp beam 10, the diameter of the same diminishes, the result of which is that, because of the number of rotations of the warp beam remaining constant in the first moment, too little warp-thread length is supplied to the weaving machine, and thereby the mean value of the up-and-down movement of the dancer 13 is altered slowly in the form of a long-term upward movement of the dancer 13. This process is established by the motion pickup 29 from the conversion computation 36, so that now the conversion relationship U initially given by the conversion computation 36 can be altered in such a manner that the diminished diameter of the warp beam 10 is taken into account. Detection, particularly of the alteration of the mean value of the dancer 13, can be accomplished though integration of the movements of the dancer, for example.

The output signal from the conversion computation 36, which represents the actual conversion relationship—that is, the conversion relationship at any given moment—is linked by the nominal value computation 37 to the signal IM, which, for example, corresponds to the number of impulses in a predetermined unit of time, and in such a manner that, at the end of the nominal value computation 37, there originates a signal (which corresponds to the desired number of impulses in the same unit of time of the impulse transmitter 27 correlated with the warp beam 10. Thus the number of impulses IM is converted to the theoretical number of impulses with the aid of the actual conversion relationship TK.

The theoretical-actual comparator 38 compares the number of theoretical impulses ISS with the number of actual impulses ISI, which normally corresponds to the output signal IS of the impulse transmitter 27 when the signal NK is equal to zero. When the number of actual impulses differs from the number of theoretical impulses, the comparator 38 generates an output signal which by means of the linkage 46 influences the warp beam drive 25 in such a manner that diminution of the diameter of the warp beam 10 is compensated by an increase in the number of revolutions of the same. Since the input signals of the theoretical-actual comparator 38 become equal in magnitude because of the increase of the number of rotations of the warp beam 10, the comparator 38 must possess storage—that is, integrating—properties in order to maintain the increased number of revolutions of the warp beam 10.

Up to this point, it has been assumed that the signal NK is equal to zero. However, this is the case only when the entire weaving machine is operating at its normal velocity of operation. If, on the contrary, an error occurs during operation, so that the weaving machine comes to a standstill, the entire weaving machine must be re-started after the error has been corrected. The signal NK is not equal to zero during this re-start and has the task of assuring precise, accurate operation of the entire weaving machine when it is started up from a stationary condition, thereby eliminating the stop marks or start marks which would normally occur.

If the weaving machine is at a standstill after the occurrence and eliminiation of an error, the warp beam 10 is rotated backward or in reverse for such a time that the zero-point pickup 31 indicates that the dancer 13 is situated in its normal position. In order that this condition may always be able to be attained, the warp beam drive 25 is so designed that the warp beam 10 comes to a standstill after the drive rollers 20, so that the dancer 13 is below its normal position and can attain the normal position through backward rotation of the warp beam 10. Specifically, the warp beam drive 25 continues to run after the drive rollers 20 stop until a selected number of pulses are generated by the impulse transmitter 27.

If the signal NP has enabled the actual-value correction 39 to recognize that the dancer 13 has attained this normal position, then, if the warp beam 10 is rotated backward even further, it counts the signals IS generated by the impulse transmitter 27. The actual-value correction 39 is allowed a specific number of impulses X with reference to the signal IM, which is converted by the actual-value correction 39, with the aid of the actual conversion relationship delivered by the conversion computation 36, into a number of impulses Y with reference to the signal IS. If the number of impulses of the signal IS delivered by the impulse transmitter 27 reaches the value of the pre-assumed number of impulses Y, the warp beam 10 is stopped. The dancer 13 is now situated in a position above its normal position, this position being clearly defined by the value of the number of impulses X.

In this process, it is important that the value X be converted to the value Y with the aid of the actual conversion relationship, as otherwise the position of the dancer 13 would be dependent on the diameter of the warp beam 10 after the warp beam 10 had been rotated backward, and therewith no definite position of the dancer 13 could be attained.

After the dancer 13 has reached the predetermined defined position through backward rotation of the warp beam 10, starting-up of the weaving machine can begin. For this purpose, first of all, the influence of the signal TS on the conversion computation 36 is eliminated, as otherwise an erroneous actual conversion would be computed by the conversion computation 36 resulting from the elevated position of the dancer 13 resulting from the backward rotation of the beam 10. In order that, during the starting-up of the weaving machine—that is, during a period of time $T_0$ necessary therefore in which the signal TS is not permitted to act upon the conversion computation 36—the signal TK, which represents the last actual conversion relationship, may remain preserved, the conversion computation 36 must have storage—fo example, integrating—properties. The period of time $T_0$, during which the signal TK is stored, is imparted to the conversion computation 36 by the actual-value correction 39, which is indicated in FIG. 1 by the broken-line arrow connection. This period of time $T_0$, is dependent on the starting-up behavior of the roller drive 26, for example.

The displacement of the dancer 13 out of its normal position before the two driving units 25 and 26 are started up presents overshooting of the dancer 13 during the re-starting process. However, the displacement of the dancer 13 must be corrected again at the end of the starting-up process—that is, after the period of time $T_0$—in order that the dancer 13 may again move up and down about its normal position in normal operation.

This correction is accomplished during starting-up of the two drive units 25 and 26 with the aid of the signal NK/generated by the actual-value correction 39. For this purpose, the actual-value correction 39 stores the value Y, about which the warp beam 10 has been rotated backward over the normal position of the dancer 13, and passes this number of impulses along, as signal NK, to the theoretical-actual-value comparator 38 during the starting-up procedure.

Thus, the signal NK manipulates the number of impulses IS in such a manner that, through control of the warp beam drive 25, the mean value of the position of the dancer 13 slowly approaches its normal position again during the starting-up process. At the end of the starting-up process—that is, after the time interval $T_0$—the signal NK is zero again, and the mean value of the position of the dancer 13 again corresponds to the normal position. At the same time now, the influence of the signal TS on the conversion computation 36 is again released, so that, after the two driving units 25 and 26 have been started up, the normal control circuit is intact again, and diminutions of the diameter of the warp beam 10 can be taken care of with the aid of the conversion computation 36.

The course of the signal NK during starting-up of the drives 25 and 26—that is, during the period of time $T_0$—is particularly dependent on the starting-up behavior of the roller drive 26. The course of the signal NK is a function which varies with the time t. It is particularly advantageous to reduce the signal NK from larger to smaller values during the starting-up process—in a linear manner, for example. Likewise, it is conceivable that the course of the signal NK is dependent of the actual conversion relationship at any given moment. For this purpose, the actual-value correction is coupled to the conversion computation 36 by means of the arrow connection represented in broken lines in FIG. 1.

The computing apparatus 35, with which the regulation of the warp beam drive 25, and especially the control of the same during starting-up, is accomplished, is built up in digital form. Thereby it is especially advantageous to employ a suitably-programmed digital computer, particularly a micro-processor. Through the use of a digital computing apparatus, it is possible, in a particularly simple and advantageous manner, not only to relate the output signal IS from the impulse transmitter 27—that is, the individual impulses of this signal—to time and therewith to compute a number of revolutions, but also to use it for odometrical measurements or angle measurements, particularly when the warp beam 10 is rotated backward. For this purpose, the individual impulses are counted and multiplied with a factor dependent on the transmitter wheel which generates the impulse, for conversion to the distance or angle covered.

Also, it is possible to carry out the function of the zero-point pickup 31 with the aid of the motion pickup 29. For this purpose, only the value measured by the motion pickup 29, which corresponds to the normal position of the dancer 13, which normally is detected by the zeropoint pickup 31, need be stored by the computing apparatus 35. Should the normal position of the dancer 13 be detected, especially during the backward rotation of the warp beam 10, then in such case the value corresponding to the dancer 13 and measured by the motion pickup 29 must be continually compared with the stored value, so that the normal position of the dancer 13 can be recognized when the two values are the same.

It is also possible not to undertake the conversion outside of the computing apparatus 35, but rather to perform it with the aid of the same. Then for this purpose it is necessary to digitalize the signal LWM and finally to convert the signal LWS into an analog value again according to the combination undertaken in the computing apparatus.

It is particularly advantageous to provide the warp beam drive 25 with a coupling and a brake, which are alternately actuated by the signal LWS, so that, all together, a drive which is variable in its number of revolutions is available. The higher the frequency of the alternate actuation of the coupling and the brake, the more precisely controllable is the number of revolutions of the warp beam drive 25.

Finally, the aforementioned dancer arrangement can be used for measuring the tension of the warp threads, and also this warp-thread tension can be measured directly by means of suitable devices, or can be measured indirectly by deflection rollers from the position of tension elements or the stress on the bearing. However, such changes in the embodiment described lie with the sphere of technical knowledge of a skilled expert.

Having described the invention in detail and by reference to preferred embodiments thereof, it will be apparent that modifications and variations are possible without departing from the scope of the invention defined in the appended claims.

What is claimed is:

1. In a method for controlling a warp beam drive of a weaving machine of the type wherein a warp beam supports a coil of warp threads and a roller drive pulls woven fabric from said weaving machine at a fixed speed, and wherein a rotational speed of said warp beam of said machine is governed by a first signal proportional to a rotational speed of said warp beam of a second signal proportional to a tension of warp threads unwound from said warp beam, an improved re-start procedure for eliminating stop marks and start marks from fabric made from said warp threads, comprising the steps of:

prior to restarting, increasing tension of said ware threads to a first predetermined level greater than a second, normal operating tension level, in digital, programmable steps, by rotating said warp beam in a reverse direction by a number of revolutions proportional to a diameter of said coil of warp threads;

starting said weaving machine by rotating said warp beam in a forward direction to unwind warp threads therefrom at a rate greater than a rate said roller drive pulls woven fabric from said weaving machine until said tension of said warp thread reduces to said second, normal operating level in a predetermined, time dependent function determined at least in part on a starting-up behavior of said roller drive;

said first predetermined level of tension forming a constant difference with said second, normal operating tension level; and a value of said constant difference being formed at least in dependence on a starting-up behavior of said roller drive.

2. An apparatus for regulating a warp beam drive of a weaving machine of the type in which a warp beam is rotated at a predetermined speed by a warp beam drive to pay out warp thread, said warp thread passes about a dancer which is biased to exert tension thereon, said warp thread passes through a weaving machine and driving rollers rotating at a constant speed, and said warp thread is wound into a roll, and including first means for regulating a speed of sid warp beam, second means for measuring a number of revolutions of said warp beam, and third means for measuring a tension of said threads and inputting to said first means, wherein the improvement comprises:

said second means including an impulse transmitter;

fourth means for measuring a speed of said driving rollers and generating a number of pulses proportional thereto;

said third means including analog to digital converting means for generating a value corresponding to a position of said dancer; and digital computer means for receiving an initial value corresponding to a starting ratio of diameters of a coil of warp thread on said warp beam and one of said driving roller, receiving and modifying pulses from said fourth means in proportion to said diameter ratio comparing said modified pulses with pulses received from said second means, adjusting said first means such that a time rate of said pulses from said second means equals said time rate of said modified pulses, and modifying said initial value by receiving and combining said digital signal from said third means with said initial value to form subsequent modified pulses, whereby a speed of said warp beams increases as a diameter of a coil on said warp beam decreases.

3. The apparatus of claim 2 wherein said third means is a potentiometer which detects a position of said dancer that determines a tensile stress or strain of said warp threads.

4. The apparatus of claim 2 wherein said warp beam drive includes a drive regulatable in its number of revolutions by means of alternate actuation of a coupling and a brake.

* * * * *

UNITED STATES PATENT AND TRADEMARK OFFICE

CERTIFICATE OF CORRECTION

PATENT NO. : 4,750,527

DATED : Jun. 14, 1988

INVENTOR(S) : Walter Rehling

It is certified that error appears in the above-identified patent and that said Letters Patent are hereby corrected as shown below:

Col. 8, line 42,"ware" should be -- warp --

Col. 9, line 7, insert -- warp -- before "threads"

Col, 9, line 19, "roller" should be --rollers --

Signed and Sealed this

Seventeenth Day of January, 1989

*Attest:*

DONALD J. QUIGG

*Attesting Officer*

*Commissioner of Patents and Trademarks*